US010794124B2

(12) United States Patent
Roberson et al.

(10) Patent No.: US 10,794,124 B2
(45) Date of Patent: Oct. 6, 2020

(54) CENTRALIZER ELECTRONICS HOUSING

(71) Applicant: Halliburton Energy Services, Inc., Houston, TX (US)

(72) Inventors: Mark Roberson, Research Triangle Park, NC (US); Scott Goodwin, Research Triangle Park, NC (US); Henry Rogers, Oklahoma City, OK (US); Nicholas Frederick Budler, Claremore, OK (US); Krishna Ravi, Kingwood, TX (US); Neal Skinner, Lewisville, TX (US); Kevin Henry, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 131 days.

(21) Appl. No.: 15/536,549

(22) PCT Filed: Feb. 9, 2015

(86) PCT No.: PCT/US2015/015006

§ 371 (c)(1),
(2) Date: Jun. 15, 2017

(87) PCT Pub. No.: WO2016/130105

PCT Pub. Date: Aug. 18, 2016

(65) Prior Publication Data

US 2017/0328144 A1 Nov. 16, 2017

(51) Int. Cl.
*E21B 17/10* (2006.01)
*E21B 47/017* (2012.01)

(52) U.S. Cl.
CPC ..... *E21B 17/1078* (2013.01); *E21B 17/1085* (2013.01); *E21B 47/017* (2020.05)

(58) Field of Classification Search
CPC . E21B 17/1078; E21B 17/1085; E21B 47/011
See application file for complete search history.

(56) References Cited

U.S. PATENT DOCUMENTS 3,991,850 A 11/1976 Escaron
5,572,021 A 11/1996 Heathman et al.
(Continued)

FOREIGN PATENT DOCUMENTS

WO WO-2014100276 A1 * 6/2014 ..... E21B 47/011

OTHER PUBLICATIONS

Merriam-Webster Definition of "Cavity". Accessed from: https://www.merriam-webster.com/dictionary/cavity on Mar. 28, 2019 (Year: 2019).*

(Continued)

*Primary Examiner* — Robert E Fuller
*Assistant Examiner* — Theodore N Yao
(74) *Attorney, Agent, or Firm* — John W. Wustenberg; Baker Botts L.L.P.

(57) ABSTRACT

A centralizer for downhole OCTG having a storage space capable of housing downhole electronics and other downhole devices, compositions and elements is disclosed. The storage space is located within an inner cavity formed in one or more of the blades making up the centralizer. A capsule is provided for protecting the contents of the items being stored within the inner cavity. The capsule may be hermetically sealed to protect the contents from the damaging effects of downhole fluids. Ports may be provided within the capsule to allow downhole electronics to be connected to sensors and other devices and components residing outside of the capsule.

17 Claims, 7 Drawing Sheets

(56) References Cited

U.S. PATENT DOCUMENTS

| | | | | |
|---|---|---|---|---|
| 5,783,822 | A | 7/1998 | Buchanan et al. | |
| 6,021,858 | A * | 2/2000 | Southland | E21B 10/43 175/393 |
| 6,089,336 | A * | 7/2000 | Nexton | E21B 10/003 175/393 |
| 6,129,161 | A * | 10/2000 | Roberts | E21B 10/55 175/393 |
| 6,230,557 | B1 | 5/2001 | Ciglenec et al. | |
| 6,283,205 | B1 | 9/2001 | Cannon | |
| 6,302,223 | B1 * | 10/2001 | Sinor | E21B 10/55 175/393 |
| 7,114,562 | B2 | 10/2006 | Fisseler et al. | |
| 7,712,527 | B2 | 5/2010 | Roddy | |
| 2003/0070803 | A1 * | 4/2003 | Gremillion | E21B 17/1028 166/241.6 |
| 2004/0178797 | A1 * | 9/2004 | Rioufol | E21B 17/1078 324/367 |
| 2011/0199228 | A1 * | 8/2011 | Roddy | E21B 33/13 340/856.4 |
| 2012/0024600 | A1 * | 2/2012 | Bittar | E21B 47/01 175/50 |
| 2012/0096935 | A1 * | 4/2012 | Finke | E21B 47/011 73/152.03 |
| 2013/0145838 | A1 * | 6/2013 | Hook | E21B 47/011 73/152.51 |
| 2014/0185201 | A1 * | 7/2014 | Barbara | H05K 5/066 361/679.01 |
| 2015/0000933 | A1 * | 1/2015 | Parry | E21B 47/011 166/381 |
| 2015/0285066 | A1 * | 10/2015 | Keller | E21B 47/011 367/82 |
| 2016/0108718 | A1 * | 4/2016 | Hato | G01R 33/0354 324/345 |

OTHER PUBLICATIONS

Centralizer Definition. Available from: http://www.oilgasglossary.com/centralizer.html (Year: 2019).*

International Search Report and Written Opinion issued in related PCT Application No. PCT/US2015/015006 dated Oct. 27, 2015, 13 pages.

International Preliminary Report on Patentability issued in related Application No. PCT/US2015/015006, dated Aug. 24, 2017 (10 pages).

* cited by examiner

CENTRALIZER ELECTRONICS HOUSING

CROSS-REFERENCE TO RELATED APPLICATION

The present application is a U.S. National Stage Application of International Application No. PCT/US2015/015006 filed Feb. 9, 2015, which is incorporated herein by reference in its entirety for all purposes.

TECHNICAL FIELD

The present disclosure relates generally to centralizers for downhole piping and tubing, and, more particularly, to a housing within the centralizers for storing downhole electronics.

BACKGROUND

Hydrocarbons, such as oil and gas, are commonly obtained from subterranean formations that may be located onshore or offshore. The development of subterranean operations and the processes involved in removing hydrocarbons from a subterranean formation typically include a number of different steps such as, for example, drilling a wellbore at a desired well site, treating the wellbore to optimize production of hydrocarbons, and performing the necessary steps to produce and process the hydrocarbons from the subterranean formation.

Upon drilling a wellbore that intersects a subterranean hydrocarbon-bearing formation, a variety of downhole tools may be positioned in the wellbore during exploration, completion, production, and/or remedial activities. For example, sensor components may be lowered into the wellbore during drilling, completion, and production phases of the wellbore. Such sensor components are often lowered downhole by a wireline, a slickline, a TEC line, a work string, or a drill string, and the sensors are used to perform a variety of downhole logging and other data gathering services. Sometimes the sensors are coupled directly to the work or drill string and in some cases they are housed within a protective housing. In some applications, sensors are used to transmit data back to the surface during production and thus may be attached to, or housed within, production casing or tubing. The term OCTG herein is defined generally to refer to tubing, casing and drill pipes whether or not manufactured according to API Specification SCT. As those of ordinary skill in the art will appreciate, a variety of transmission media may be used to communicate downhole data to the surface, e.g., fiber optic lines, traditional electrical or conductive wires, which can communicate analog and/or digital signals, and data buses. Data can also be transmitted wirelessly or through acoustic waves which may use a variety of media including fluids and downhole tubing and/or other piping.

In most downhole applications, simply attaching the sensors to the downhole piping or tubing is not an acceptable means of delivering the sensors downhole because of the harsh downhole environment. Therefore, it often becomes necessary to store the sensors in a protective housing to ensure safe delivery of the sensors. However, downhole space is limited, because there are often numerous devices needing to be delivered downhole to perform a variety of operations and because ample space needs to be reserved for the delivery and retrieval of fluids downhole. Given these tight space constraints, it is desirable to minimize the space occupied by the equipment and other elements delivered downhole.

The present disclosure is directed to creating a chamber or housing within centralizer blades for storing downhole sensors and other downhole equipment, including, e.g., but not limited to, MEMS devices, batteries, hydraulic control components, valves, downhole optics, downhole fiber optics and other such devices. As those of ordinary skill in the art will appreciate, such a chamber or housing within the centralizer blades can also be used to store downhole chemicals or acting as a storage chamber for oil and other hydraulic fluids. The details of the present disclosure, with reference to the accompanying drawings, are provided below.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
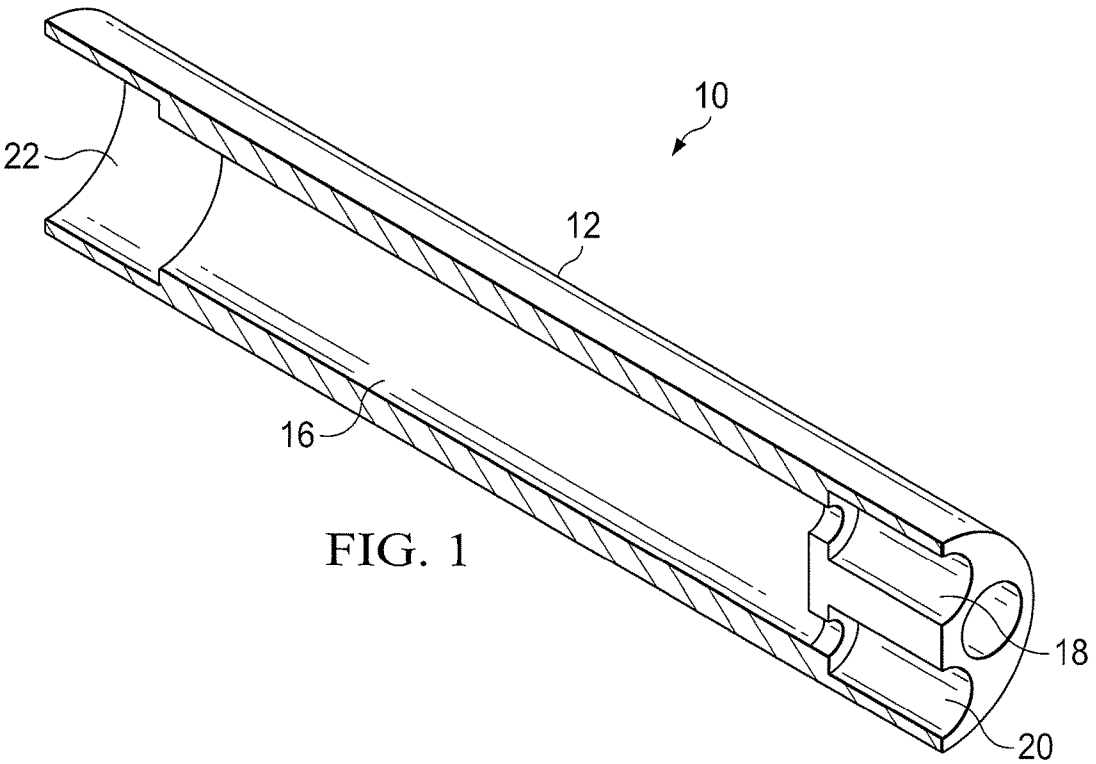
FIG. 1 is an elevational, cross-sectional view of a capsule for housing downhole electronics and other downhole components and elements for use in drilling, competing and producing a well in accordance with the present disclosure.
Figure 2:
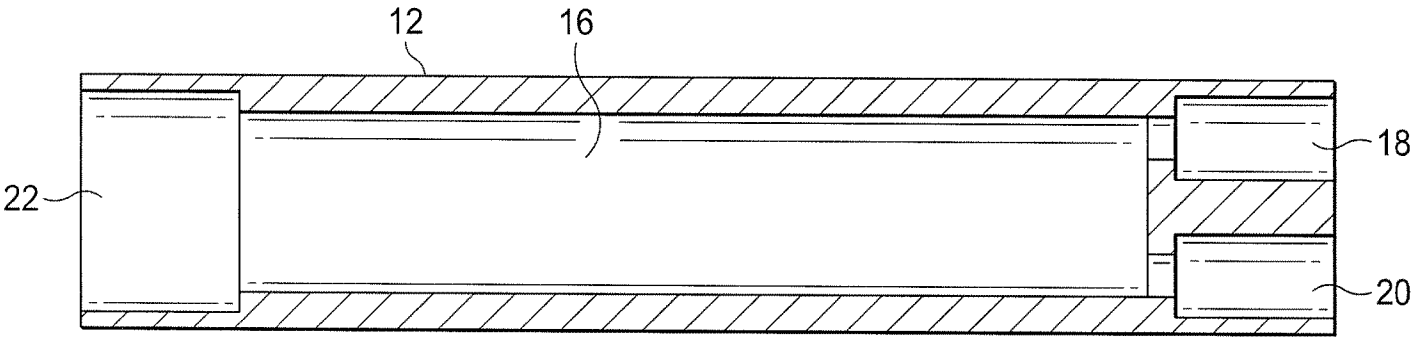
FIG. 2 is a planar, cross-sectional view of the capsule shown in FIG. 1.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

In accordance with one embodiment of the present disclosure, a capsule 10 is provided for delivering an article downhole. The capsule has a housing 12 which is adapted to be contained within a centralizer blade 14 (shown in FIG. 5). The housing 12 includes an inner cavity 16 which is configured to store articles for downhole delivery. In one embodiment, the inner cavity 16 is formed of a hermetically sealed chamber. The housing 12 includes one or more ports 18, 20 and 22 for accommodating any necessary wires for the article (not shown) being stored within the inner cavity 16. The wires can be, e.g., feed-through connections for a battery, PCB device or other electronic device (not shown). The ports 18, 20 and 22 can be hermetically sealed using known sealing compositions and techniques, for example, but not limited to an epoxy, rubber or polymeric seals. Furthermore, as one of ordinary skill in the art will appreciate, any number of ports may be provided depending upon the electronic device being stored within the inner cavity 16 and the necessary number of connections such device may need to connect to the outside environment.

Figure 3:
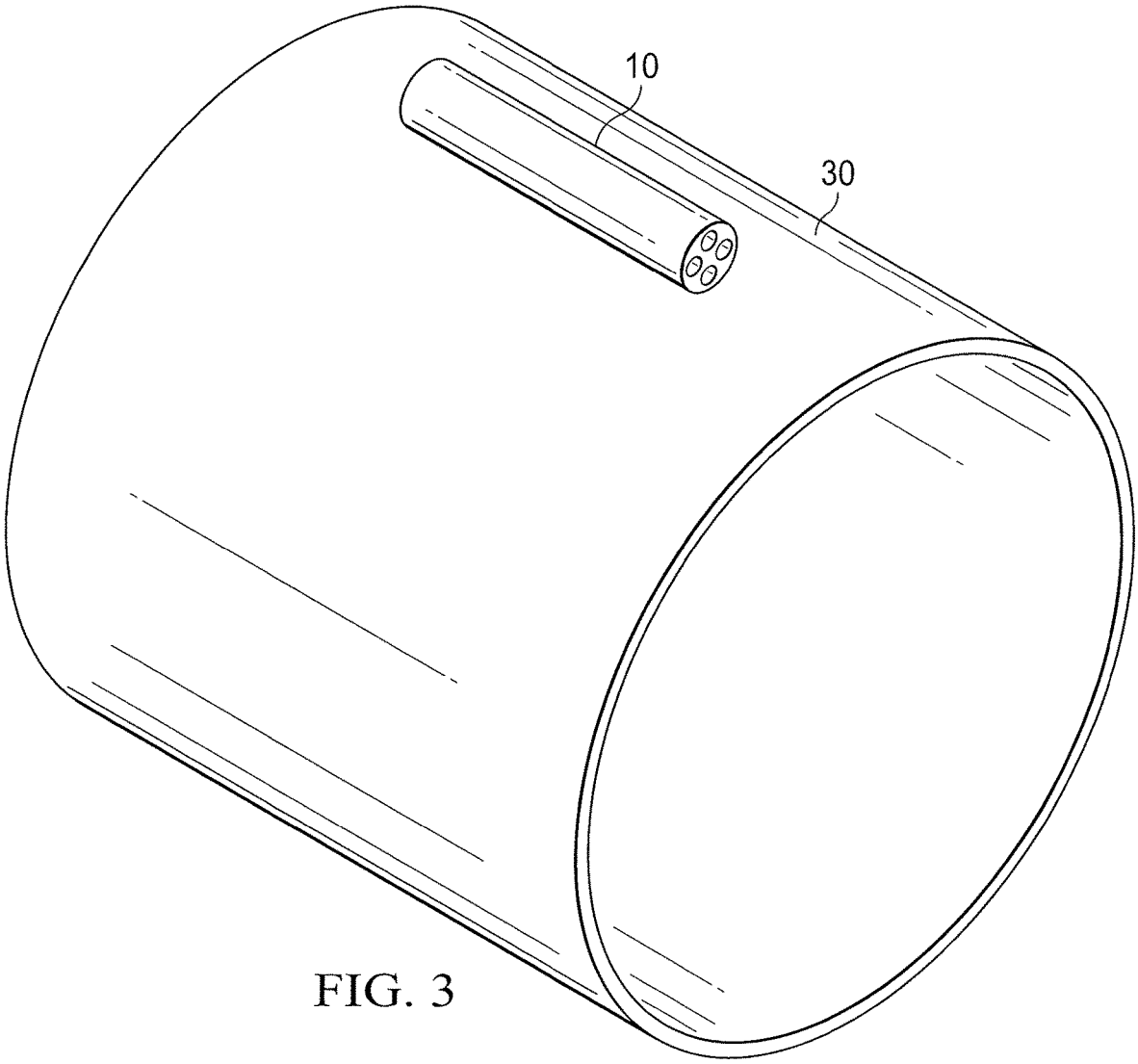
FIG. 3 is an elevational view of the capsule shown in FIGS. 1 and 2 mounted on a tubular member in accordance with the present disclosure.
Figure 4:
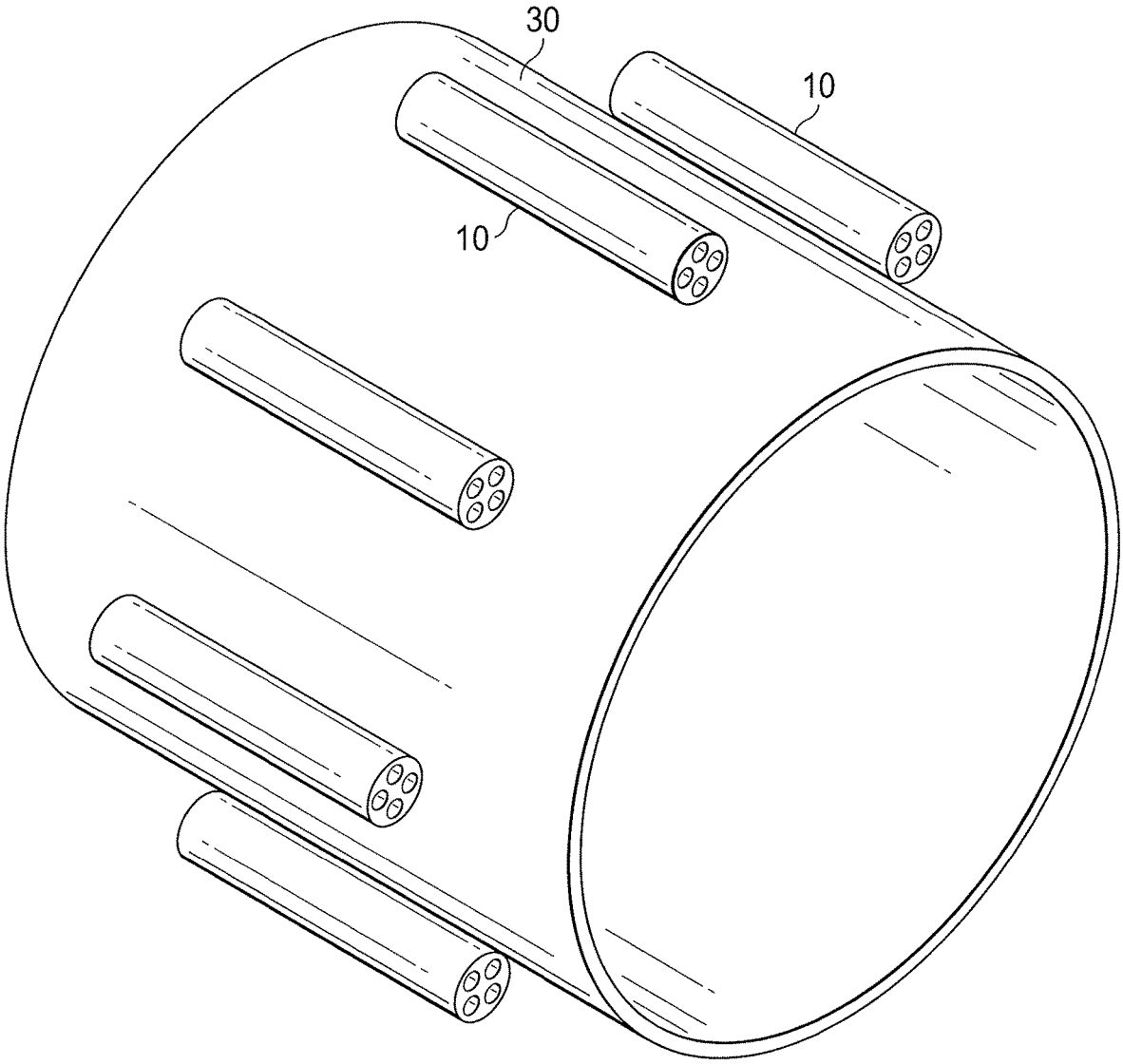
FIG. 4 is an elevational view of a plurality of the capsules shown in FIGS. 1 and 2 mounted around the circumference of a tubular member in accordance with the present disclosure.
Figure 5:
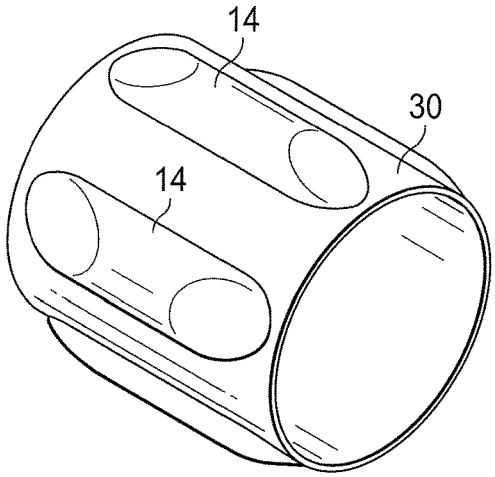
FIG. 5 is an elevational view of a plurality of centralizer blades mounted around the circumference of a tubular member in accordance with the present disclosure.

In one embodiment, the capsule 10 is mounted to or otherwise disposed on or around the outer circumferential surface of a tubular member 30, as shown in FIG. 3. In one exemplary embodiment, a plurality of capsules 10 are mounted to or otherwise disposed on or around the outer circumferential surface of a tubular member 30, as shown in FIG. 4. In the embodiment shown in FIG. 4, the capsules 10 are optionally equally spaced around the outer circumferential surface of the tubular member 30. FIG. 5 shows the centralizer blades 14 disposed around the outer circumference surface of the tubular member 30. The capsules are not visible in this figure as then would be housed within the centralizer blades.

Figure 6A:
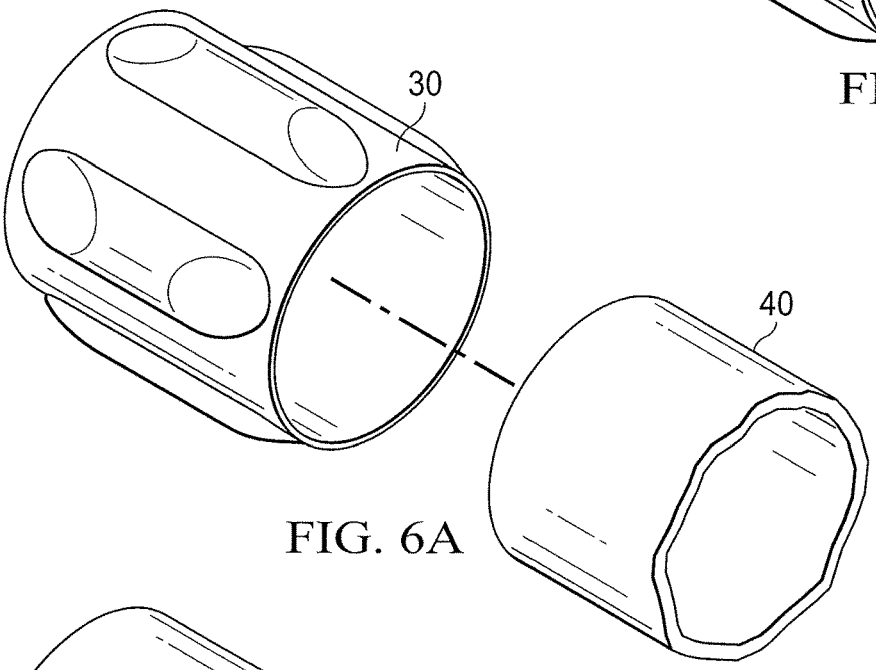
FIGS. 6A and 6B illustrates the tubular member of FIG. 5 being disposed around a section of pipe in accordance with the present disclosure.
Figure 6B:
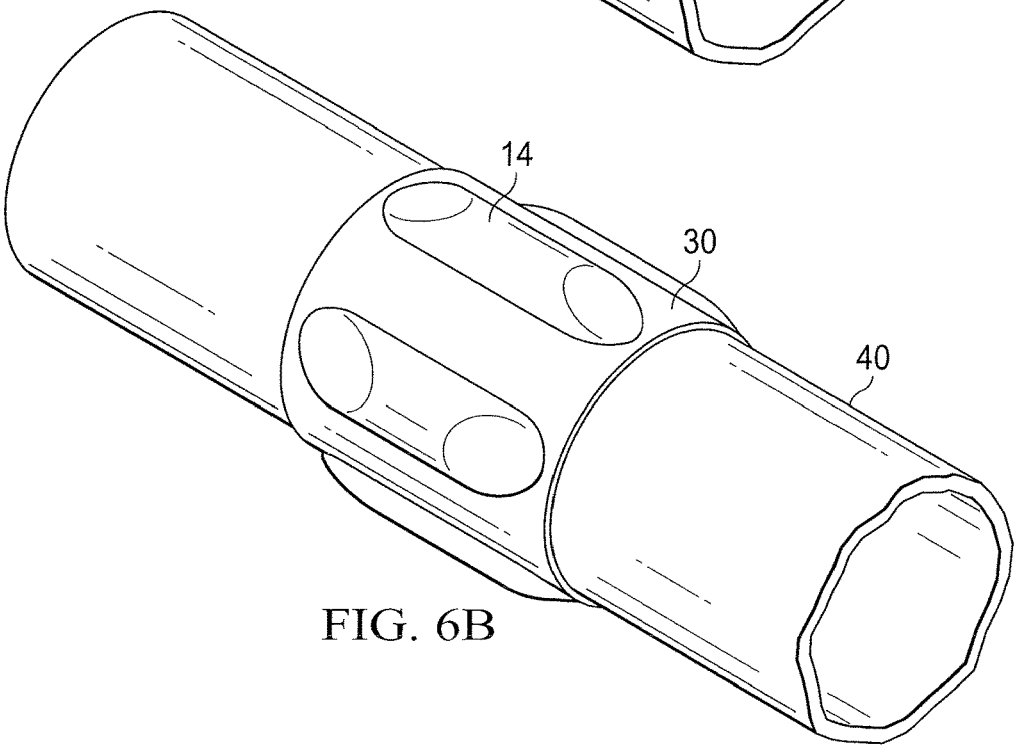
Figure 10:
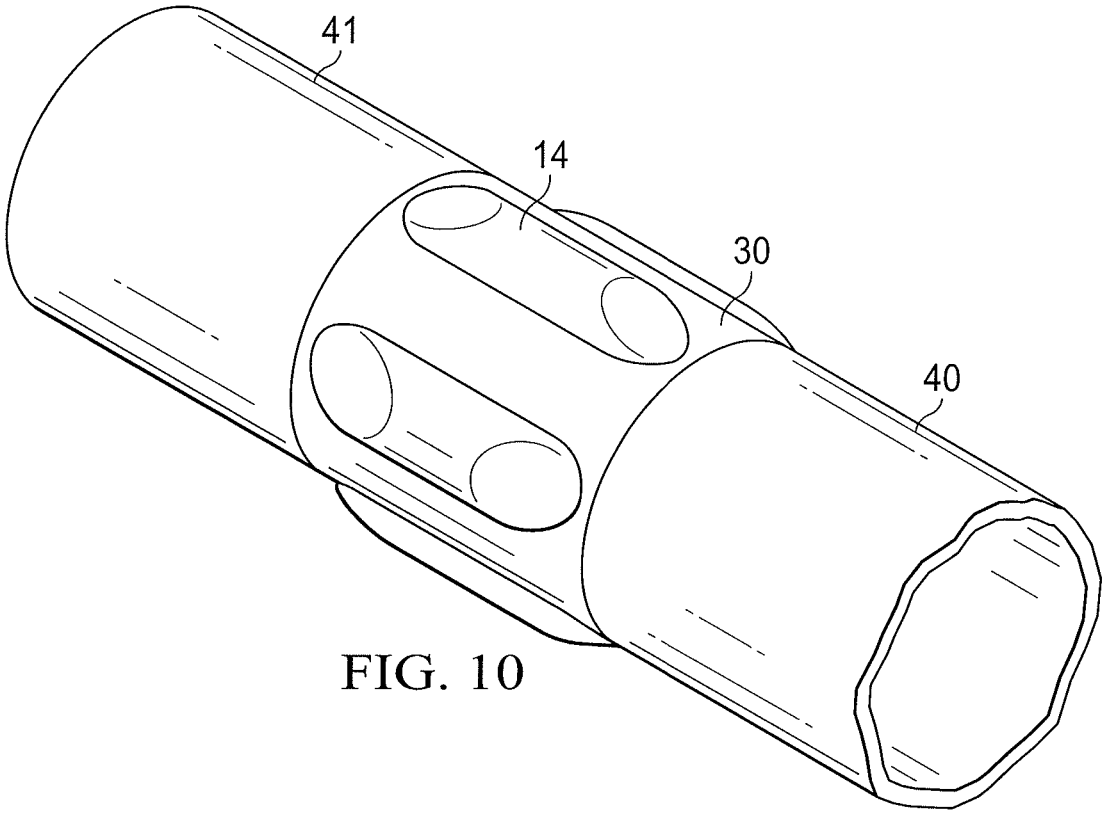
FIG. 10 is a schematic illustrating the tubular member connecting two adjacent sections of pipe.
Figure 11:
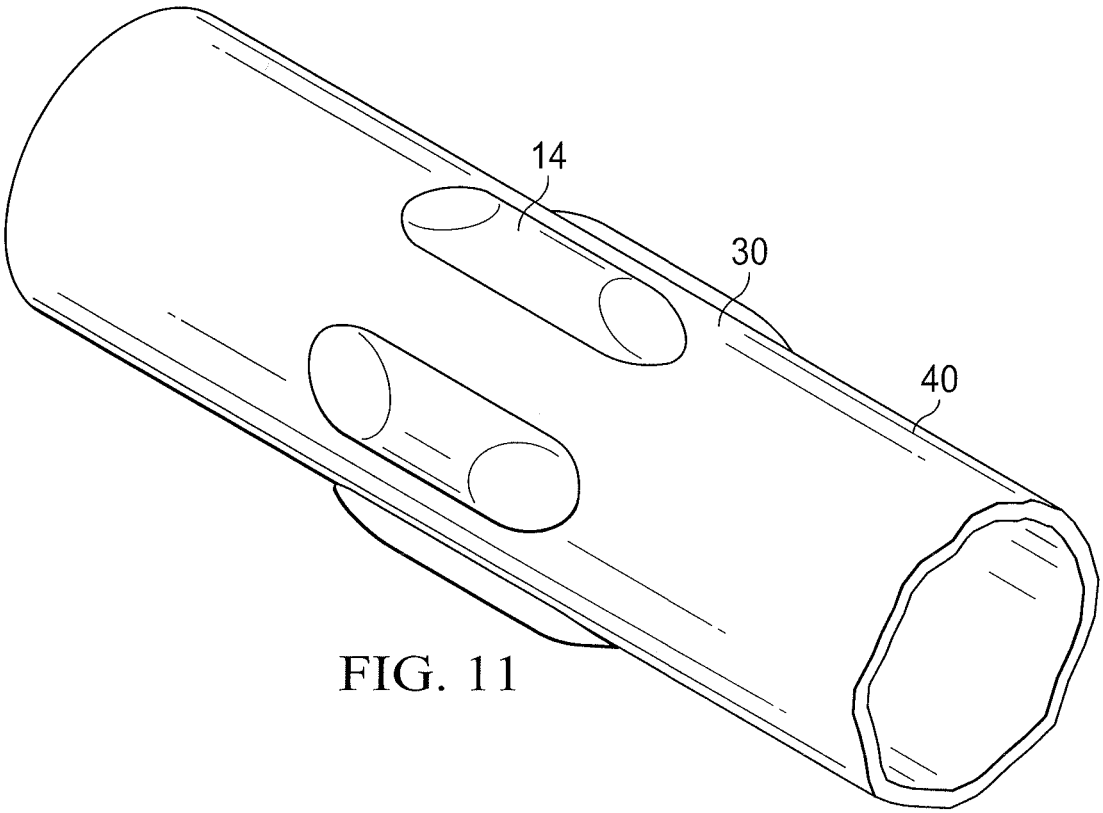
FIG. 11 is a schematic illustrating the centralizer being formed directly onto a section of pipe.

In one exemplary embodiment, the tubular member 30 is a sleeve which joins two adjacent sections of OCTG 40 and 41, as shown in FIG. 10. In another embodiment, the sleeve 30 is disposed over the outer circumferential surface of a section of OCTG 40, as shown in FIGS. 6A and 6B. In yet another embodiment, the tubular member 30 is a section of OCTG, i.e., the centralizer is formed directed onto the section of OCTG, as shown in FIG. 11. Methods of installing the centralizer blades 14 to the OCTG also include installing them as a slip-on sleeve, similar to solid centralizers known in the art, clamp-on sleeves similar to the bow-spring centralizers, and separate subs that are directly made up to the OCTG. Furthermore, as those of ordinary skill in the art will recognize, the geometry of the centralizer blades 14 can take many forms, including, but not limited to, straight blades, spiral blades, buttons, and wear pads/bands.

Figure 7:
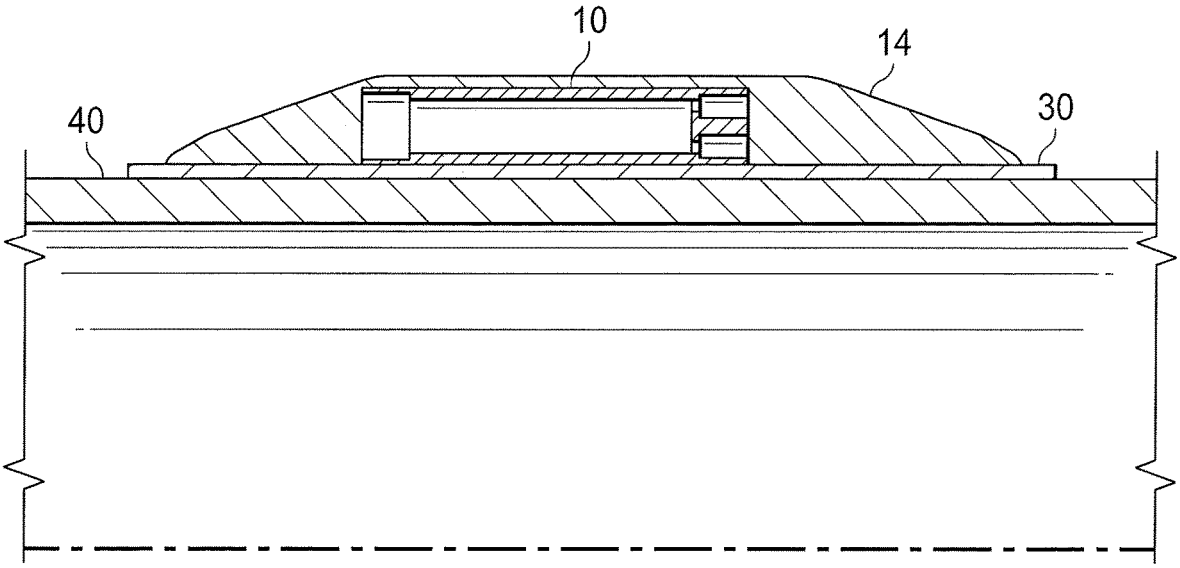
FIG. 7 is a partial cross-sectional cutaway view of the the capsule shown in FIGS. 1 and 2 disposed within a centralizer blade mounted on a tubular member in accordance with the present disclosure.

As shown in FIG. 7, the capsule 10 is placed inside of a centralizer blade 14, which in turn is mounted to the outer circumferential surface of tubular member 30. The tubular member 30 in FIG. 7 is shown disposed around a section of OCTG 40. As indicated above, the tubular member 30 can alternately connect adjacent sections of OCTG or be a section of OCTG. The capsule 10 can be encapsulated with a Protech™ resin to aid in wear and protection. Other resin materials could be used, including, but not limited to, Well-Lock™ resin,Thermatek™ resin, as well as other polymer resins. Any array of such capsules 10 can be affixed to the tubular member 30 around its circumferential surface, as shown in FIG. 4 so as to achieve enough sensory pickup capabilities that 360 degrees of coverage is possible. The completed assembly could then pick up the signal from the downhole tags without imparting a large ECD (Equivalent Circulating Density) on the annular flow path. The arrangement of the array of capsules 10 and associated centralizer blades 14 around the tubular member 30 can be in one of many configurations, including but not limited to, a staggered array, a sequential array and a circular array. Furthermore, the centralizer blades 14 can be formed on the tubular member 30 using known techniques, including but not limited to, molding the blades onto the tubular member 30, welding them or otherwise attaching and/or forming the blades in place.

There are a number of alternative configurations that can be utilized for the capsule 10 in lieu of the tubular enclosure with a hollow core illustrated in FIG. 1. In one such alternative embodiment, the capsule is a square housing with a bored core. In another alternate embodiment, the capsule is formed of a housing which is provided with a lid for access to the contents. In yet another embodiment, a three-dimensional enclosure is provided that uses either the surface of the sleeve or outer circumferential surface of the wall of the OCTG as a retaining surface.

Figure 8:
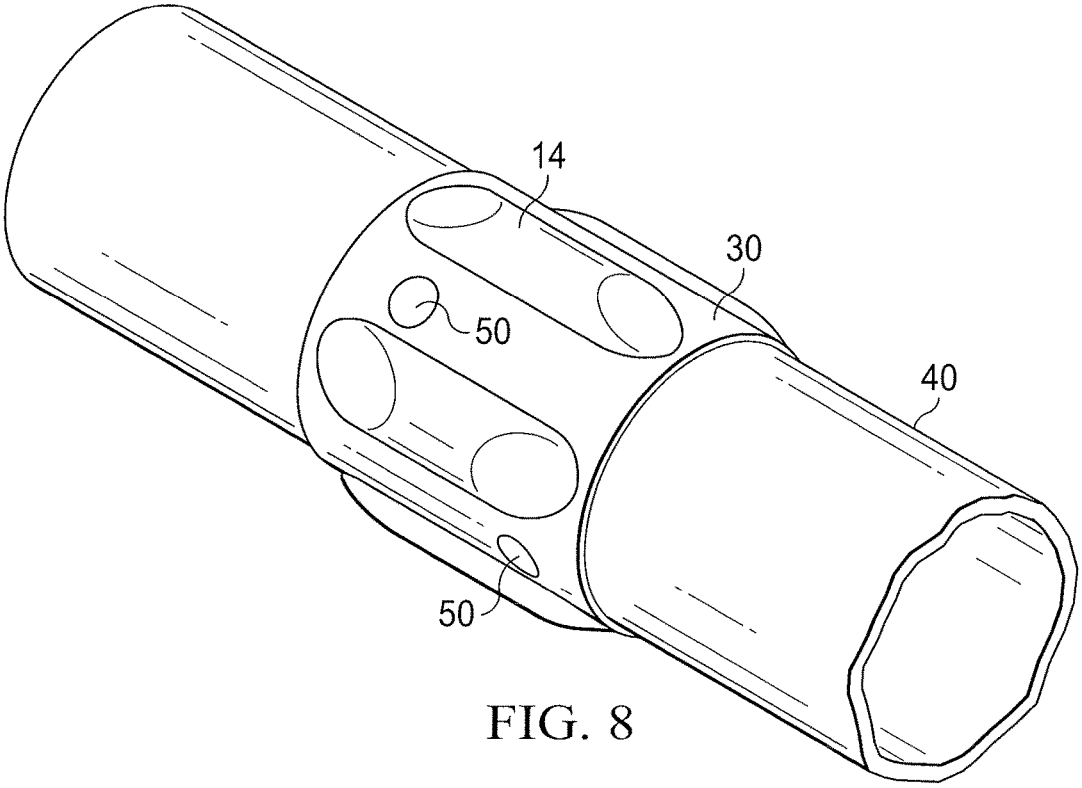
FIG. 8 is an elevational view of a centralizer having a plurality of sensors mounted between adjacent centralizer blade in accordance with the present disclosure.

One or more transducers 50 may be mounted on the tubular member 30 between adjacent centralizer blades 14, as shown in FIG. 8. The transducers 50 can be used for acoustic/RF logging of MEMS sensors, RF sensing of the fluid environment for inferring the fluids and geometric arrangements, and ultrasonic sensors for sensing the annulus region fluids and surrounding environment. The transducers 50 can be connected to a receiver housed within the capsule 10 via electrical wires, through the ports 18, 20 and/or 22 or alternately can be connected wirelessly via an RF connection. The receivers (not shown) housed within the capsules 10 emit a signal that is read and interpreted by the transducers 50 throughout the wellbore. The transducers 50 and wires mounted outside of the capsules 10 on the outer surface of the tubular member 30 are preferably protected from the harsh effects of the downhole environment, for example, by being placed within channels formed in the outer surface of the tubular member 30 and encased in a resin material. Those of ordinary skill in the art will recognize other means of protecting the transducers 50 and wires from the downhole environment.

Figure 9:
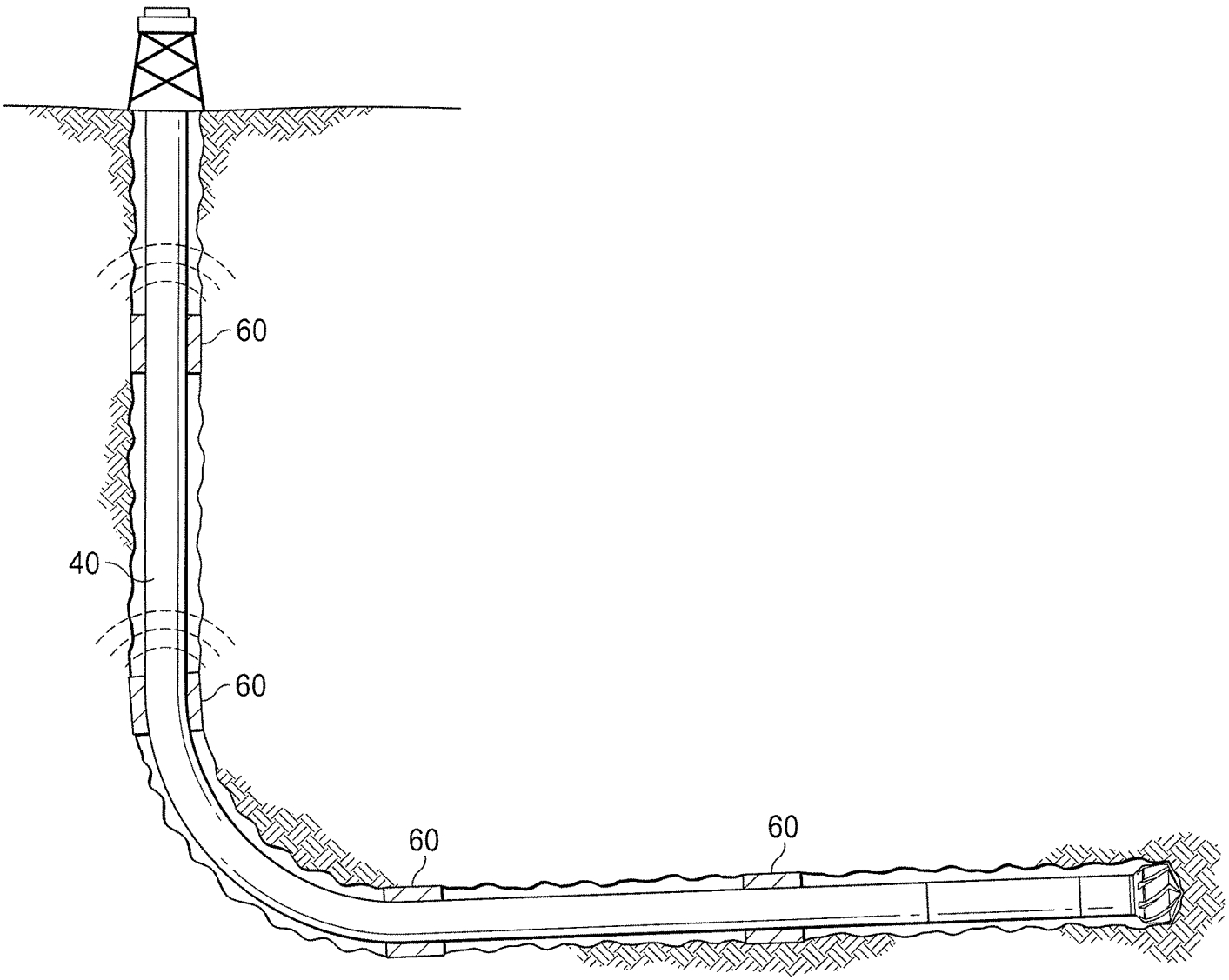
FIG. 9 is a schematic illustrating a plurality of transducers disposed along a wellbore acting as relay nodes in accordance with the present disclosure.

The present disclosure contemplates transmitting data between adjacent nodes 60 along the wellbore, as illustrated in FIG. 9. Those of ordinary skill in the art will determine the preferred spacing of the nodes 60 for various applications. In one embodiment, the nodes 60 are placed roughly 10 meters apart to the topmost sensor node in the depth of interest. From that point to the surface, communication can occur using conventional methods, including, e.g., logging tools with connections above, connections to fiber optics on the next casing or topmost node, copper wires on the next casing or topmost node, short-range wireless hops including magnetic induction, surface waves, RF signals, acoustic, ultrasonic or pressure modulation pulses, along the entire length of casing string. Other options for communicating with the downhole sensors associated with the smart centralizer of the present disclosure include use of a temporary internal fiber optic line connection to the top plug during cementing, fiber optic lines along production tubing, and/or use of copper wire connecting all of the nodes 60. Also, the same methods available for communicating from the top node to the surface can be used for communicating between nodes downhole.

Systems that can be used as the electronic interface from the downhole sensors 50 to a surface unit (not shown), can include, but are not limited to, iCem, rig software or computer systems, and Smartphones.

If the tubular member 30 is a separate sleeve and not the OCTG itself, there will be an inherent gap between the OCTG outer diameter and the sleeve inner diameter. A filler material therefore may be desirably used to optimize the mounting of the ultrasonic transducer. This is because acoustic waves travel much more reliably and consistently through solid matter than through air. There would also be a fair amount noise if this gap were to remain while the tool travels downhole. The filler material may include, e.g., an epoxy (for better acoustic coupling) or iron filled epoxy (for better EM coupling between the sleeve and OCTG).

There are a host of applications for the smart centralizer in accordance with the present disclosure. One use is to provide an indication of cement, mud and/or slurry displacement during a cementing operation. Another application is to verify proper plug dispersion and thereby increase the reliability of this downhole step. Another application is to verify that surface objects, e.g., plugs, balls, darts and the like have been launched. Yet another application includes reducing NPT (non-productive time) by not having to stop a job to replace a plug that, unknowingly, did not launch or did not reach its desired depth. Another application includes reducing NPT by not requiring the operator to guess where returns have gone. Still another application includes integrating the readout to be consistent with existing software. Existing software systems can graphically predict the placement and efficiency (among other things) of a cement job. The information gathered from the proposed sensory system can be integrated with existing ones to improve forecasting techniques and accuracy.

Although the present disclosure and its advantages have been described in detail, it should be understood that various changes, substitutions and alterations can be made herein without departing from the spirit and scope of the disclosure as defined by the following claims.

What is claimed is:

1. A centralizer for downhole oil country tubular goods (OCTG), comprising:

a tubular member disposable about a first section of tubing, wherein the tubular member connects the first section of tubing to one or more other sections of tubing;

a plurality of blades disposed around an outer circumference surface of the tubular member, at least one blade of the plurality of blades having an inner cavity, wherein the at least one blade is a centralizer blade; and a capsule disposed within the inner cavity of the at least one blade, the at least one capsule capable of storing an article for use downhole;

one or more transducers communicatively coupled to the capsule, wherein the one or more transducers are mounted in one or more channels in an outer surface of the tubular member between adjacent blades of the plurality of blades, wherein the one or more transducers are encased, and wherein the one or more transducers receive a signal from within the capsule.

2. The centralizer of claim 1, wherein each blade of the plurality of blades having an associated inner cavity and a separate capsule disposed in each associated inner cavity.

3. The centralizer of claim 1, wherein the plurality of blades are equally spaced around the circumferential surface of the tubular member.

4. The centralizer of claim 1, wherein the article is selected from the group consisting of downhole electronics, downhole chemicals, MEMS devices, batteries, hydraulic control components, valves, oil chambers, downhole sensors, downhole optics, downhole fiber optics and combinations thereof.

5. The centralizer of claim 1, wherein the article includes downhole electronics connected to the one or more transducers via at least one wire.

6. The centralizer of claim 5, further comprising a polymer material disposed over the one or more transducers and the at least one wire to protect the one or more transducers and the at least one wire from a downhole environment.

7. A downhole apparatus, comprising:

a tubular member of a section of tubing, wherein the tubular member connects one or more sections of tubing to the section of tubing;

a plurality of blades disposed around an outer circumference surface of the tubular member, at least one blade of the plurality of blades having an inner cavity, wherein the at least one blade is a centralizer blade;

at least one capsule disposed within the inner cavity of the at least one blade;

downhole electronics contained within the at least one capsule; and one or more transducers communicatively coupled to the capsule, wherein the one or more transducers are mounted in one or more channels in an outer surface of the tubular member between adjacent blades of the plurality of blades, wherein the one or more transducers are encased, and wherein the one or more transducers receive a signal from within the capsule.

8. The downhole apparatus of claim 7, wherein each of the plurality of blades has an associated capsule an associated inner cavity and a separate capsule disposed in each associated inner cavity.

9. The downhole apparatus of claim 8, wherein the downhole electronics in at least one of the capsules is capable of transmission of an acoustic signal to the downhole electronics in at least one other capsule.

10. The downhole apparatus of claim 7, wherein the plurality of blades are equally spaced around the circumferential surface of the tubular member.

11. The downhole apparatus of claim 7, further comprising at least one wire connecting the one or more transducers to the downhole electronics.

12. The downhole apparatus of claim 11, further comprising a polymer material disposed over the one or more transducers and the at least one wire to protect the one or more transducers and the at least one wire from a downhole environment.

13. A capsule disposed around a circumferential surface of a tubular member of a section of tubing such that the tubular member connects one or more sections of tubing to the section of tubing, the capsule for delivering an article downhole, the capsule comprising:

a housing contained within a centralizer blade of a plurality of centralizer blades of a centralizer an inner cavity disposed within the housing, wherein the inner cavity stores the article; and wherein the capsule is configured to couple to one or more encased transducers mounted in one or more channels in an outer surface of the tubular member between adjacent blades of the plurality of centralizer blades, and wherein the capsule is configured to transmit one or more signals to the one or more transducers.

14. The capsule of claim 13, further comprising a hermetically sealed chamber contained within the inner cavity.

15. The capsule of claim 14, further comprising at least one port interfacing with the hermetically sealed chamber.

16. The capsule of claim 15, further comprising downhole electronics disposed within the inner cavity, at least one wire passing through the at least one port for connecting the downhole electronics to at least one sensor disposed in an environment outside of the capsule which is capable of measuring downhole conditions.

17. The capsule of claim 13, wherein the article is selected from the group consisting of downhole electronics, downhole chemicals, MEMS devices, batteries, hydraulic control components, valves, oil chambers, and downhole sensors, downhole optics, downhole fiber optics and combination thereof.

* * * * *